US006418625B1

(12) United States Patent
Baum

(10) Patent No.: US 6,418,625 B1
(45) Date of Patent: Jul. 16, 2002

(54) CUTTING APPARATUS

(75) Inventor: Steven Glen Baum, North Canton, OH (US)

(73) Assignee: The Goodyear Tire & Rubber Company, Akron, OH (US)

( * ) Notice: Subject to any disclaimer, the term of this patent is extended or adjusted under 35 U.S.C. 154(b) by 0 days.

(21) Appl. No.: 09/897,321

(22) Filed: Jun. 29, 2001

(51) Int. Cl.[7] ..... B26B 13/22

(52) U.S. Cl. ..... 30/233; 30/131
(58) Field of Search ..... 30/233, 254, 131, 30/286, 289, 287, 124

(56) References Cited

U.S. PATENT DOCUMENTS

| | | | | | |
|---|---|---|---|---|---|
| 3,010,206 | A | * | 11/1961 | Curry | 30/131 |
| 3,078,503 | A | * | 2/1963 | Webb | 30/233 |
| 6,145,203 | A | * | 11/2000 | Appleman | 30/233 |
| 6,308,421 | B1 | * | 10/2001 | Wang | 30/233 |

FOREIGN PATENT DOCUMENTS

| | | | | |
|---|---|---|---|---|
| CA | 464926 | * | 5/1950 | 30/233 |

* cited by examiner

*Primary Examiner*—Hwei-Siu Payer
(74) *Attorney, Agent, or Firm*—David E. Wheeler

(57) ABSTRACT

An apparatus for cutting pic cords of a fabric material comprises a pair of blades, each blade having a cutting portion wherein the cutting portion comprises a cutting edge and a non-cutting edge. The pair of blades are disposed such that a cutting edge of a first blade comes into contact with a cutting edge of a second blade when the blades are pressed together. A wing having a left portion and a right portion are connected to the non-cutting edge of the first blade. The wing has a substantially V or U-shape such that the left portion and the right portion of the wing each take an arcuate path from the connection point of the wing on the non-cutting edge of the blade toward the cutting edge and away from the cutting portion. The flat portions of the wings, i.e., the ends of the wings are disposed so that they are proximal to a plane which is substantially perpendicular to the first blade and contains the cutting edge of the first blade. In a method of the invention, the apparatus described is provided, and the apparatus is used by disposing an end of the first blade, and the connecting point of the wings to the blade, below the plane of the fabric while disposing the ends of the wing above the plane of fabric. In the method, the apparatus is moved such that the cutting edges of the first and second blade come together causing cutting of the fabric. The apparatus is continuously moved along the fabric such that the wings separate cut edges of the fabric as the apparatus is moved, and the blades are continuously moved to continue to cut the fabric.

3 Claims, 4 Drawing Sheets

CUTTING APPARATUS

FIELD OF THE INVENTION

The invention relates to an apparatus for cutting a fabric material.

BACKGROUND OF THE INVENTION

In the construction of reinforced polymeric components, such as reinforced rubber components that are used in the construction of tires, the reinforcement often comprises a fabric having high strength warp cords which are held together by a lower strength, and often lower density weft or pic cords. In the construction of the reinforced component, the fabric is calendered with a polymer, or is by some other means embedded within the polymer. In order for the reinforced component to function properly in a product in which it is used, it is often necessary to break or cut the pic cords so that the warp cords may move independently of one another.

In the preparation of the fabric material, or the testing of the fabric material, or a composite in which the fabric material is used, it is often necessary to separate the material or the composite in such a manner that an unbroken warp cord is present at the edge of the fabric or the composite. Often, the cutting means used to cut the fabric or the composite is capable of very easily cutting the warp cords if the person operating the cutting means gets off line. When the material being cut is a composite, for example, it often is the case that the polymer material surrounding the reinforcement cords is much tougher to cut than the reinforcement cords, and when such polymer is warped or bent it makes it difficult for the person operating the cutting means to stay on line.

Accordingly, there is a need the art for equipment that makes it easier to prepare fabric and composite samples, or to prepare components on the building line, where a sample or a component having uninterrupted reinforcement cords is needed.

SUMMARY OF THE INVENTION

An apparatus is provided for cutting between the cords of a filament reinforced material. The apparatus comprises a pair of blades, each blade having a cutting portion comprising a cutting edge and a non-cutting edge, the pair of blades being disposed such that a cutting edge of a first blade comes into contact with a cutting edge of a second blade when the blades are pressed together. A wing having a left portion and a right portion is connected to the non-cutting edge of the first blade, the wing having a substantially V or U shape such that the left portion of the wing and the right portion of the wing each take an arcuate path from the connection point of the wing on the non-cutting edge toward the cutting edge and away from the cutting portion. In the illustrated embodiment, the ends of the right portion and left portion of the wings are proximal to a plane which is substantially perpendicular to the first blade and contains the cutting edge of the first blade.

Also provided is a method for cutting between the cords in a filament reinforced material comprising the steps of providing a cutting apparatus of the invention as described herein, and disposing an end of the first blade and the connecting point of the wings below the plane of the material such that ends of the wings are above the plane of the material, and moving the blades relative to each other such that the cutting edges of the first and second blades cause cutting of the material, and continuously moving the apparatus and material relative to each other such that the wings separate cut edges of the material as the movement continues, and continuously moving the blades to continue to cut the material.

It is an object of the present invention to provide an apparatus and method for obtaining a sample or a component by cutting between the warp cords in a fabric material or a composite.

Other objects of the invention will be apparent from the following description and claims.

BRIEF DESCRIPTION OF THE DRAWINGS

The invention will be described by way of example and with reference to the accompanying drawings in which.

DETAILED DESCRIPTION OF THE INVENTION

In the illustrated embodiment, the apparatus of the invention comprises shears having a winged attachment. The apparatus of the invention is described as a pair of shears for ease of description. Those skilled in the art will recognize that the cutting means of the apparatus of the invention may have different structures and configurations and provide substantially the same function. For example, the cutting means may comprise an apparatus having one blade substantially stationary on a larger piece of equipment and a second blade, which is movable relative to the stationary blade, which is not hinged to the stationary blade. The winged portion of the apparatus may be attached to the stationary blade in a manner similar to that described for the illustrated embodiment herein.

Figure 1:
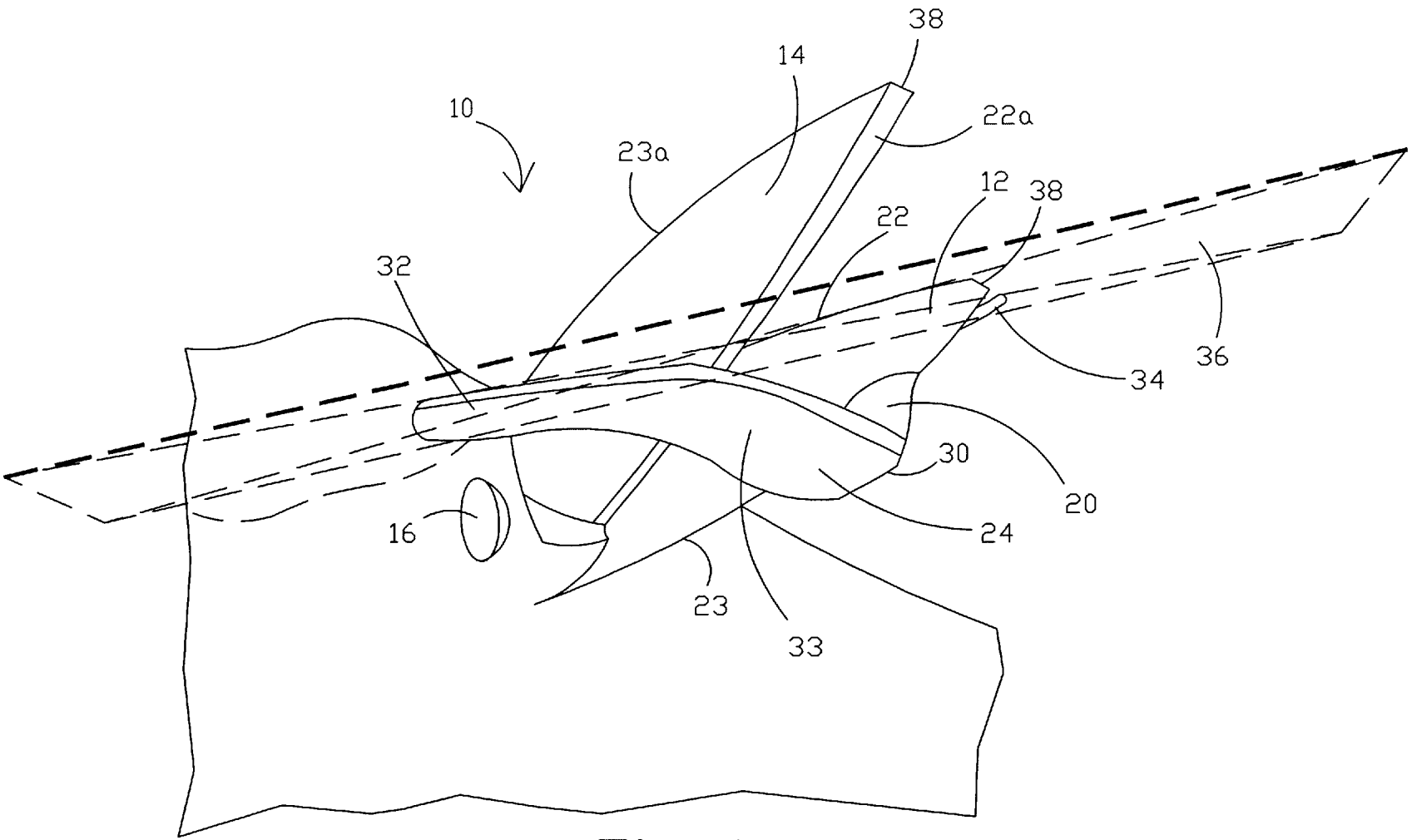
FIG. 1 illustrates an enlarged view of the apparatus including the connection point of a blade of the apparatus to the wings of the apparatus.
Figure 3:
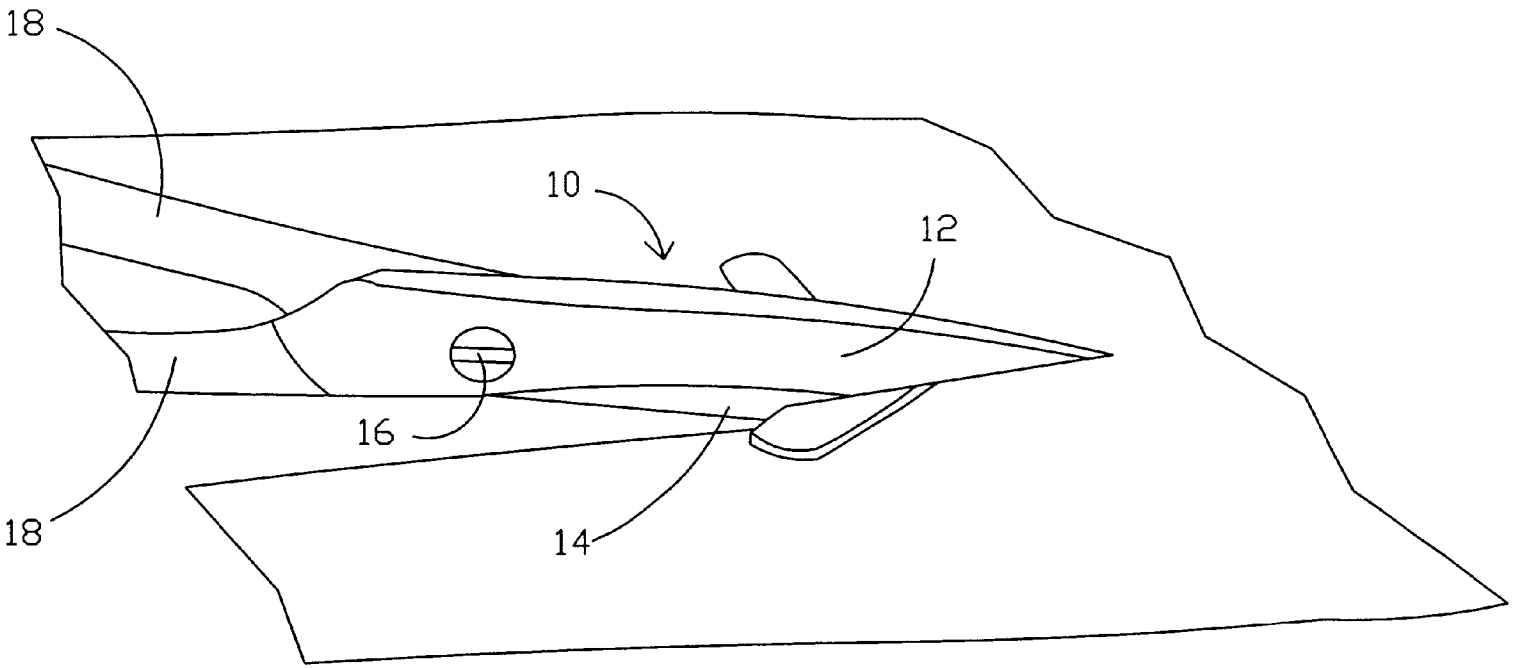
FIG. 3 illustrates a perspective side view of an apparatus of the invention.

With reference now to FIGS. 1 and 3, the illustrated apparatus 10 of the invention comprises a first blade 12 and a second blade 14 which are connected together by hinge 16. The first blade 12 and second blade 14 each have a handle 18 for the convenience of the operator in rotating the first blade and second blade relative to each other on hinge 16. The cutting portion of each blade has a cutting edge 22, 22*a* and a non-cutting edge 23, 23*a*. In the illustrated embodiment, wing 24 is attached to non-cutting edge 23 of first blade 12.

Figure 2:
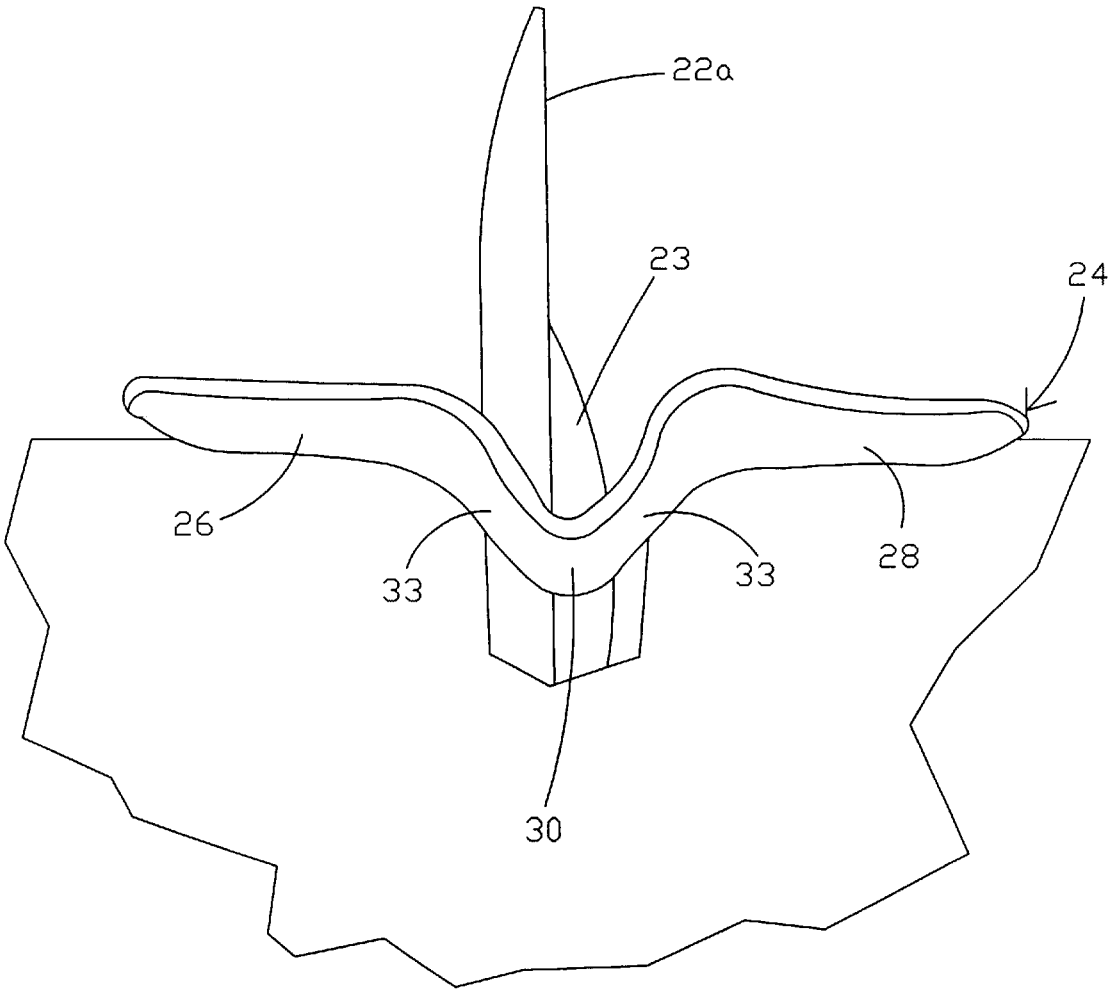
FIG. 2 illustrates an apparatus as seen from below the apparatus.

With reference now to FIGS. 1 and 2, wing 24 has a left portion 26 and a right portion 28. Left portion 26 and right portion 28 extend outward and upward from connection point 30 where wing 24 is connected to non-cutting edge 23 of first blade 12. That is, left portion 26 and right portion 28 each take an arcuate path from connection point 30 toward cutting edge 22 and away from first blade 12.

In the illustrated embodiment, wing 24 comprises an eighth inch thick Teflon strip that has been cut to the desired size and bent into the desired shape, and has been attached to non-cutting edge 23 using epoxy 20.

It is preferred that wing 24 comprises a fairly rigid, stable, non-stick material such as Teflon, stainless or aluminum.

Those skilled in the art will recognize that stainless type materials can be welded to the non-cutting edge 23 of the blade, and aluminum type material can be attached mechanically, for example, by a set screw. Other suitable means of attachment for different kinds of materials will be apparent to those skilled in the art.

With reference now to FIG. 1, a flattened portion of the wing lies substantially parallel to a plane 36 which is perpendicular to first blade 12 and contains cutting edge 22. The flat portion of the wing may be defined by left wing end 32, and right wing end 34, which may be in plane 36, or slightly below plane 36, and may be parallel with the plane or at slight angles to the plane.

Figure 4:
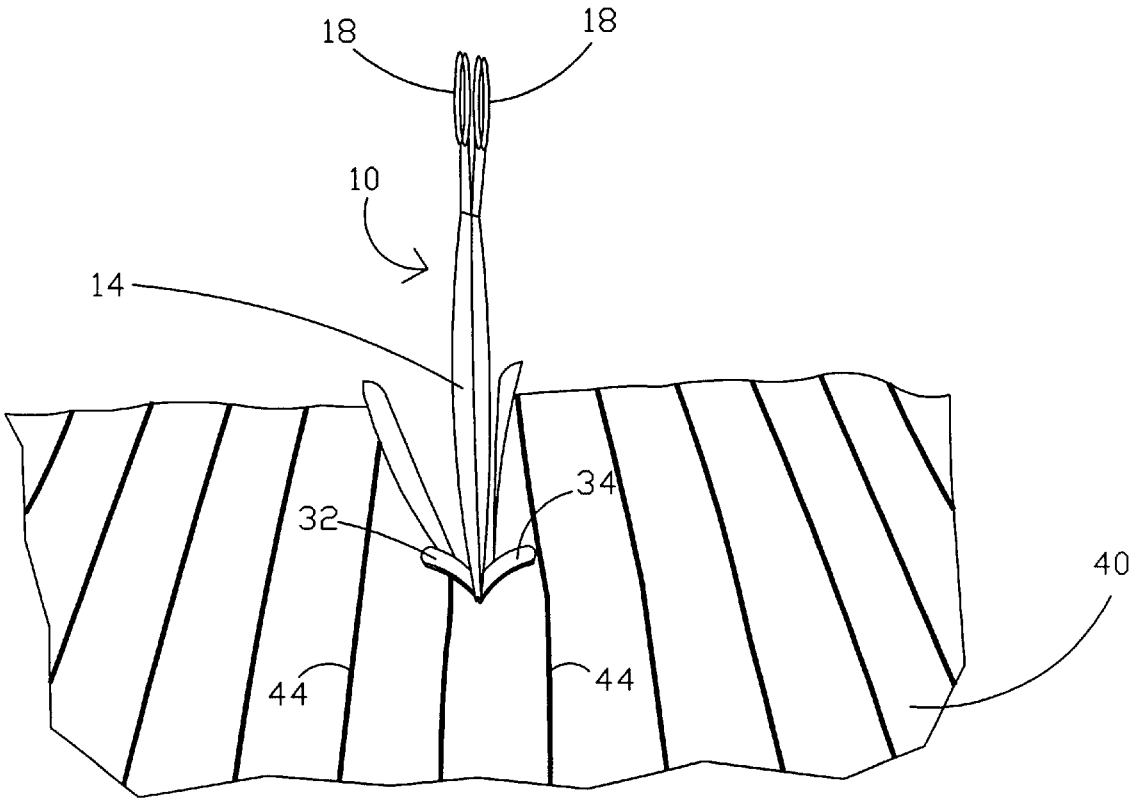
FIG. 4 illustrates an elevated front view of an apparatus of the invention in use.

With reference to FIGS. 1, 3 and 4, in the use of apparatus 10, the end 38 of first blade 12 is placed below the surface of a fabric or a composite to be cut such that connection point 30 between the wing 24 and non-cutting edge 23 of blade 12 is on one side of the fabric and the left wing end 32 and right wing end 34 and second blade 14 are above the fabric. In the initial starting position, apparatus 10 is placed between two warp cords 44 of the fabric or composite. In its operation, apparatus 10 is pushed forward into fabric 40 wherein wing 24 pushes between two warp cords 44 substantially separating them from one another. Arcuate portion 33 of wing 24 provides a guide between the two warp cords 44, separates the cords and assures alignment of first blade 12 and second blade 14 between warp cords 44. Second blade 14 is moved back and forth on hinge 16 relative to first blade 12 such that the action of cutting edges 22 and 22*a* of first blade 12 and second blade 14 cause cutting of the composite or pic cords between warp cords 44.

For best results, it has been found that when the flat portions 32, 34 of wings 24 are substantially within plane 36 or slightly below plane 36, the cut edges of the fabric are held down and away from second blade 14, facilitating the cutting operation. When the left wing end portion 32 and right wing end portion 34 are above plane 36 there is potential that fabric 40 will be too high on second blade 14, which may defeat the aligning function of wing 24.

The angles and shape of the wings may be modified to be more acute or obtuse to optimize their use for a specific task.

Although end 38 of first blade and second blade 14 have a point in the illustrated embodiment, for the type of cutting illustrated herein, such points may not be needed.

Those skilled in the art will recognize that the invention may be modified for use for a specific purpose.

While the invention has been specifically illustrated and described, those skilled in the art will recognize that the invention may be variously modified and practiced without departing from the spirit of the invention. The invention is limited only by the scope of the following claims.

What is claimed is:

1. An apparatus for cutting between cords of a filament reinforced material comprising (a) a pair of blades, each having a cutting portion comprising a cutting edge and a non-cutting edge, the pair of blades being disposed such that a cutting edge of a first blade comes into contact with a cutting edge of a second blade when said blades are pressed together (b) a wing having a left portion and a right portion connected to the non-cutting edge of said first blade, said wing having a substantially V or U shape such that the left portion of the wing and the right portion of the wing each take an arcuate path from the connection point of the wing on the non-cutting edge of said first blade toward the cutting edge of said first blade and away from the cutting portion of said first blade, respectively.

2. The apparatus of claim 1 wherein the ends of the right portion and left portion of said wing are proximal to a plane which is substantially perpendicular to said first blade and contains the cutting edge of said first blade.

3. A method for cutting between cords in a filament reinforced material comprising the steps of (a) providing a pair of blades, each having a cutting portion comprising a cutting edge and a non-cutting edge, the pair of blades being disposed such that a cutting edge of a first blade comes into contact with a cutting edge of a second blade when said blades are pressed together (b) attaching a wing having a left portion and a right portion to the non-cutting edge of said first blade, said wing having a substantially V or U shape such that the left portion of the wing and the right portion of the wing each take an arcuate path from the connection point of the wing on the non-cutting edge of said first blade toward the cutting edge of said first blade and away from the cutting portion of said first blade (c) disposing an end of said first blade and the connecting point of said wing below the plane of the material such that ends of said wing are above the plane of the material (d) moving said second blade such that the cutting edges of the first and second blades cause cutting of the material (e) continuously moving said first and second blades relative to said material such that said wing separates cut edges of the material as the first and second blades are moved, and (f) continuously moving said second blade to continue to cut said material.

* * * * *